US005267875A

United States Patent [19]

Koegel et al.

[11] Patent Number: 5,267,875

[45] Date of Patent: Dec. 7, 1993

[54] ELECTRICAL CONNECTOR ASSEMBLY

[75] Inventors: Keith S. Koegel, Linglestown; Reuben E. Ney, Mount Joy; Mark A. Wojcicki, Hershey; William E. Zelko, Dauphin; Charles A. Miller, York New Salem, all of Pa.

[73] Assignee: The Whitaker Corporation, Wilmington, Del.

[21] Appl. No.: 53,832

[22] Filed: Apr. 27, 1993

[51] Int. Cl.[5] ..... H01R 13/00

[52] U.S. Cl. ..... 439/497; 439/607

[58] Field of Search ..... 439/492–499, 439/607–610

[56] References Cited

U.S. PATENT DOCUMENTS

| | | | |
|---|---|---|---|
| 3,958,852 | 5/1976 | Abraham et al. | 339/91 P |
| 4,083,615 | 4/1978 | Volinskie | 339/17 F |
| 4,310,208 | 1/1982 | Webster et al. | 339/14 R |
| 4,415,216 | 11/1993 | Narozny | 439/497 |
| 4,579,404 | 4/1986 | Lockard | 339/14 R |
| 4,602,830 | 7/1986 | Lockard | 339/14 R |
| 4,602,831 | 7/1986 | Lockard | 339/14 R |
| 4,655,515 | 4/1987 | Hamsher, Jr. et al. | 339/14 R |
| 4,767,357 | 8/1988 | Hasircoglu | 439/499 |
| 4,875,877 | 10/1989 | Fleak et al. | 439/497 |
| 4,973,264 | 11/1990 | Kamono et al. | 439/498 |
| 4,993,968 | 2/1991 | Guletsky et al. | 439/492 |
| 5,030,138 | 7/1991 | Capp et al. | 439/497 |
| 5,057,038 | 10/1993 | Bowen et al. | 439/497 |
| 5,085,595 | 2/1992 | Koegel et al. | 439/494 |
| 5,178,560 | 1/1993 | Yaegashi et al. | 439/497 |

*Primary Examiner*—Joseph H. McGlynn

[57] ABSTRACT

A connector assembly (6) comprises, conductive signal contacts (9) and a ground bus (10), a separator (16) between first and second rows of the contacts (9), the contacts (9) and the ground bus (10) being supported against the separator (16), the separator (16) having fingers (19) between adjacent contacts (9) of each row, and the ground bus (10) and the contacts (9) being of greater height than the fingers (19) for ease in connection to wires (2, 5) of an electrical cable (1).

16 Claims, 4 Drawing Sheets

ELECTRICAL CONNECTOR ASSEMBLY

FIELD OF THE INVENTION

The invention relates to an electrical connector assembly for attachment to wires of at least one electrical cable, and, more particularly, to adapting a connector assembly for weld connection or solder connection to wires of at least one electrical cable.

BACKGROUND OF THE INVENTION

A connector assembly disclosed in U.S. Pat. No. 4,875,877, comprises, a conductive ground bus, for connection to ground wires of at least one electrical cable, and conductive signal contacts for connection to signal wires of at least one electrical cable, the signal contacts being joined to the ground bus, the signal contacts being constructed for being detached from the ground bus, and at least one of the signal contacts remaining joined to the ground bus. A lead frame joins the ground bus and the signal contacts. The contacts are modified to adapt them for connection to wires of at least one electrical cable. The contacts are modified with an insulating housing applied over the contacts, by injection molding, for example. Windows in the housing block expose the contacts for connection of the contacts with respective wires of at least one electrical cable. The contacts, after being connected with respective wires, are then assembled in a housing to provide a connector assembly. Accordingly, the contacts are modified to adapt them for connection to wires of at least one electrical cable.

SUMMARY OF THE INVENTION

According to a feature of the invention, an insulative block is added to a connector assembly of standard construction, involving rows of electrical contacts in an insulative housing. The added housing block supports the contacts while they are connected to wires of at least one electrical cable. The added block is a substitute for a manufacturing operation that would have modified the contacts to adapt them for connection to the wires. Accordingly, a connector assembly of standard construction is adapted to be connected to wires without a need to alter the standard construction.

The added block further supports the contacts while selected ones of the contacts are separated from a ground bus.

According to the invention, an electrical connector assembly comprises, an insulative housing block, multiple electrical contacts projecting outwardly of the housing block for connection to wires of at least one electrical cable, an insulative block, a conductive ground bus supported against the insulative block, selected ones of the contacts being constructed for detachment from the ground bus to provide free ends of said ones of the contacts, and each of the contacts being supported against the insulative block, said free ends being supported against the insulative block while being connected to respective wires of at least one electrical cable.

Embodiments of the invention will be described by way of example with reference to the accompanying drawings, according to which:

DETAILED DESCRIPTION

Figure 4:
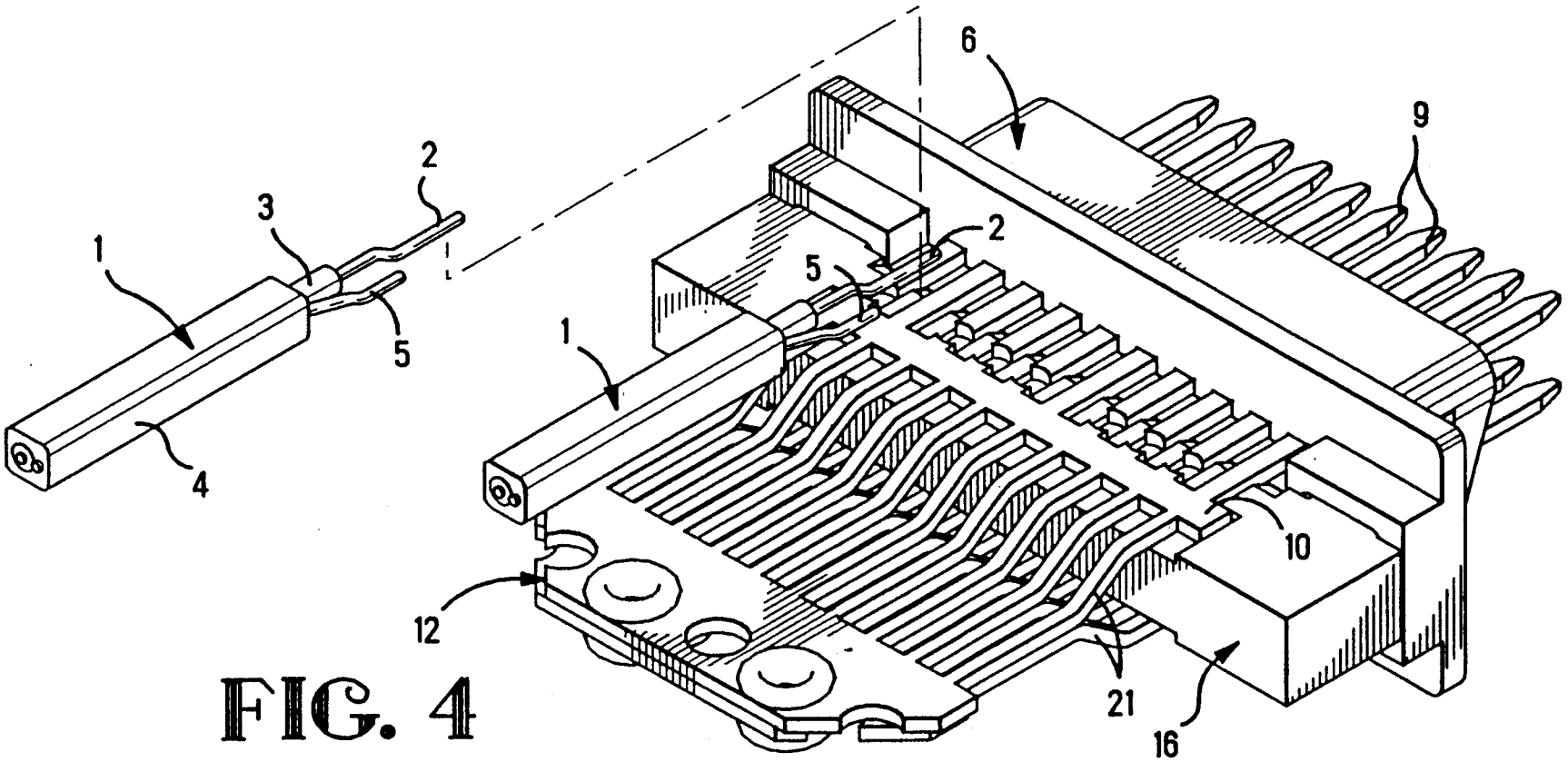
FIG. 4 is a perspective view similar to FIG. 2, and illustrating contacts of a connector assembly being connected to wires.
Figure 5:
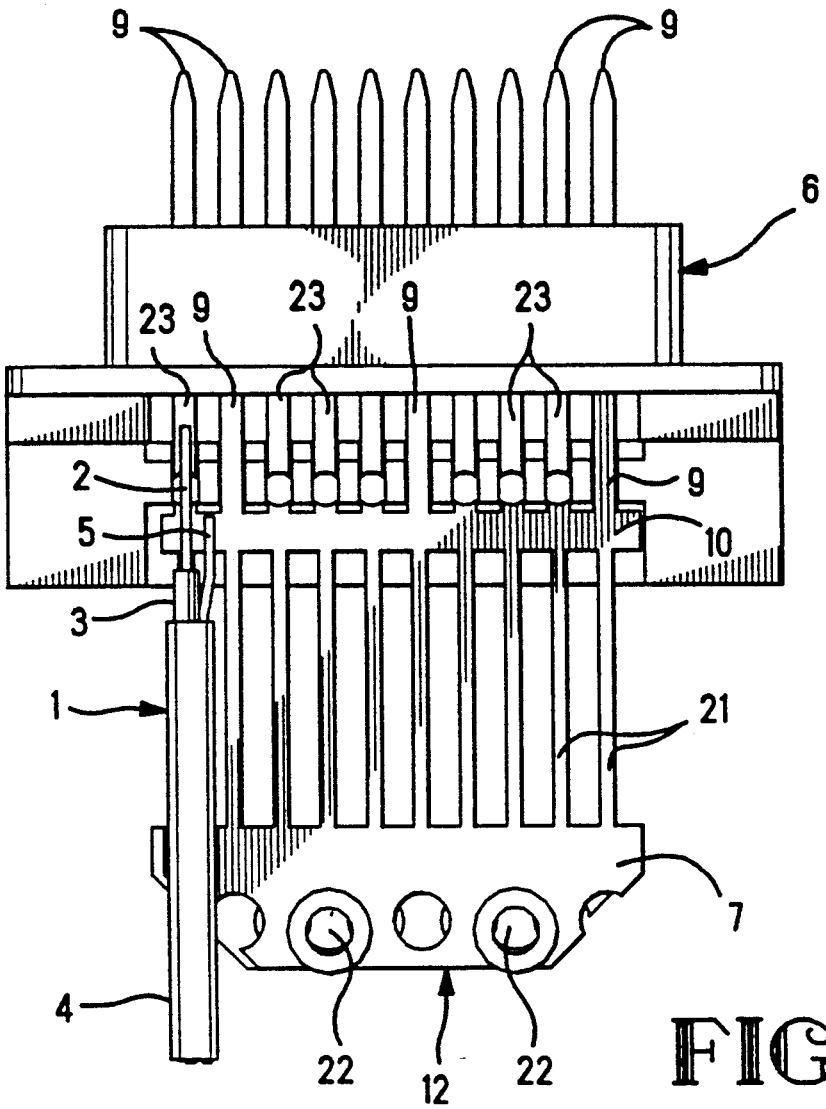
FIG. 5 is a top plan view of the connector assembly shown in FIG. 4.
Figure 6:
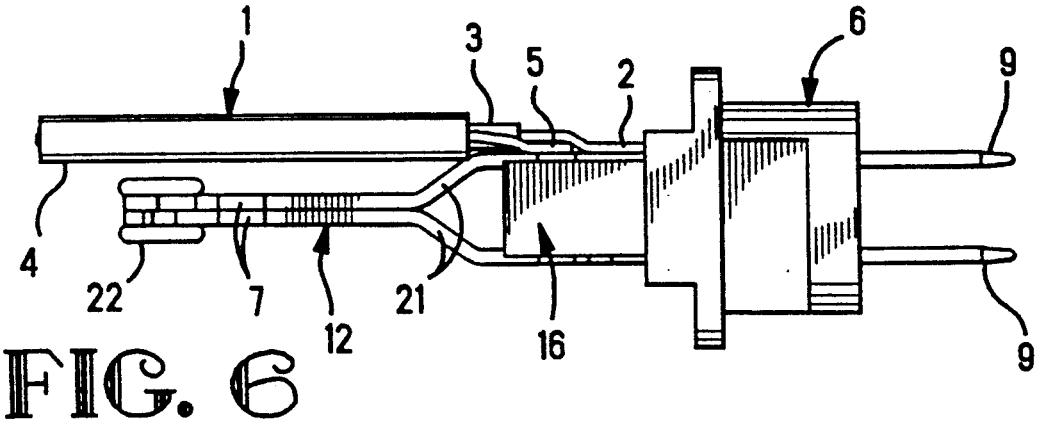
FIG. 6 is a side elevation view of the connector assembly shown in FIG. 4.

With reference to FIGS. 4–6, at least one electrical cable 1 comprises an elongated signal wire 2 or center conductor concentrically encircled by a dielectric 3, in turn, encircled by a flexible insulative outer jacket 4 or sheath. A corresponding, elongated and conductive ground wire 5 or drain wire extends along the exterior of the dielectric 3 and is within the jacket 4. The cable may include a single ground wire 5, as shown, or may include first and second ground wires 5 to provide a combination of a signal wire 2 between two ground wires 5.

With reference to FIGS. 1 and 4–6, an electrical connector assembly 6 is to be connected to one or multiple electrical cables 1. The connector assembly 6 is constructed with at least one row of conductive electrical contacts 9 projecting forwardly from an elongated ground bus 10. A series of pilot holes 11 extend through a carrier strip 7. A lead frame 12 joins the contacts 9 and the ground bus 10 and the carrier strip 7. The contacts 9 are on pitch spacings, that are the repeated spacings between longitudinal axes of the multiple contacts 9 in a row. The connector assembly 6 further comprises an insulative housing 13 having cavities 14 on the pitch spacings of the contacts 9. The contacts 9 extend along the cavities 14 and project rearwardly of the housing 13. Rearward facing latch elements in the form of recesses 15 of rectangular shape in the housing 13 are at opposite ends of the row of contacts 9. The connector assembly 6 further comprises a second lead frame 12 comprising, a second row of contacts 9 spaced from the first row of contacts 9. A second ground bus 10 and a second carrier strip 7 with pilot holes 11 aligned with the pilot holes 11 of the first carrier strip 7.

Figure 1:
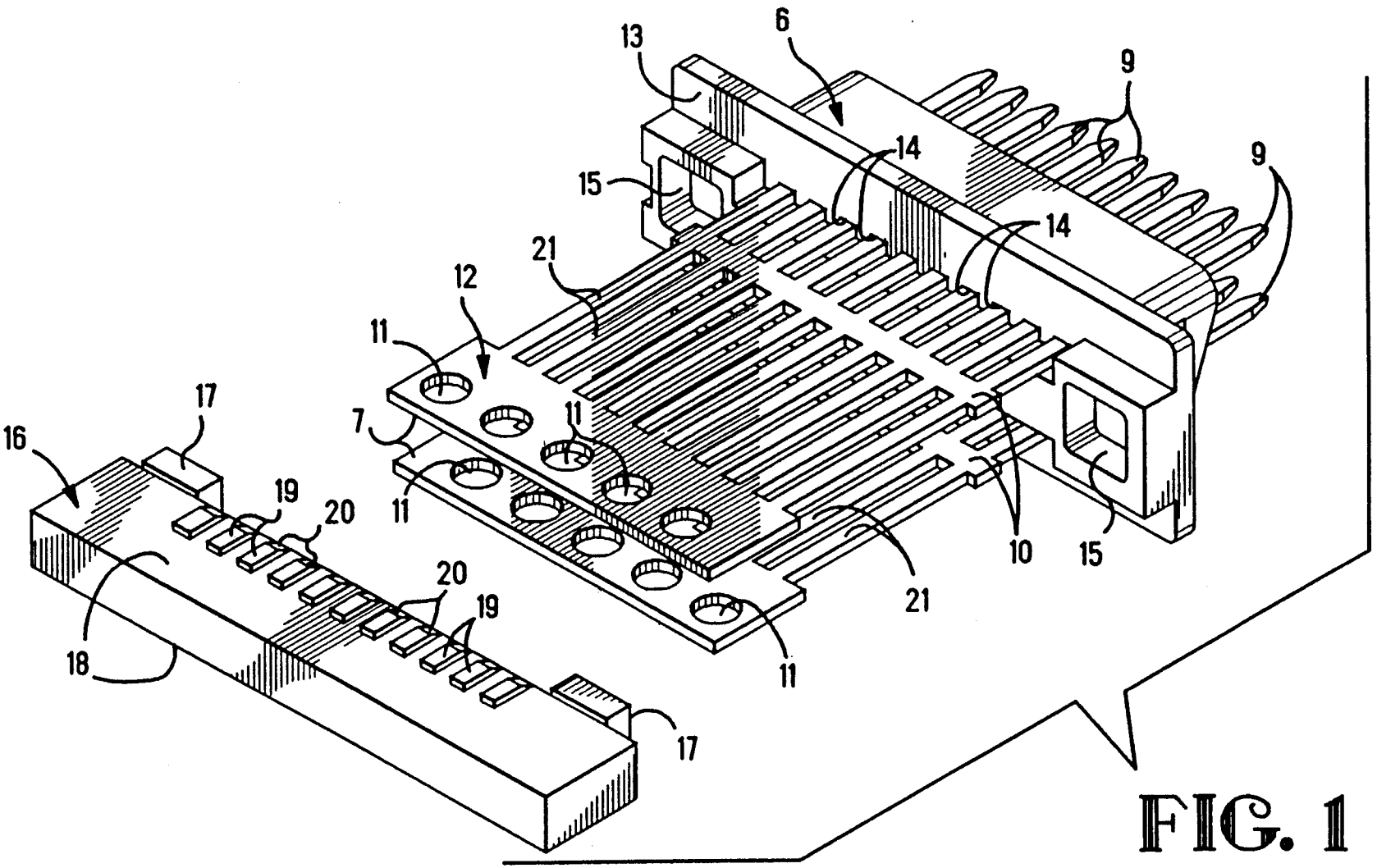
FIG. 1 is a perspective view of a connector assembly adapted with an insulative block, with parts separated from one another.

A separator in the form of an insulative block 16, as a separate part of unitary construction, FIG. 1, has projecting latch elements 17 for alignment and latched attachment to the housing 13 in the recesses 15. The insulative block 16 is inserted between the rows of contacts 9. The insulative block 16 has opposite flat surfaces 18 from which project a series of spaced apart fingers 19. Front ends 20 of the fingers 19 are tapered for passage of each ground bus 10 over respective fingers 19 during insertion of the insulative block 16 between the rows of contacts 9. Each ground bus 10 and the contacts 9 joined to the ground bus 10 are supported against one of the flat surfaces 18 of the insulative block 16. The fingers 19 extend alongside the contacts 9. Adjacent contacts 9 are separated from one another by the fingers 19 to prevent electrical shorting. The housing block 16 is assembled to the housing 13 separately from the contacts 9. Accordingly, no modification of the contacts 9 is required to support the contacts 9 and the ground bus 10 against the insulative block 16. The ground bus 10 is joined to the carrier strip 7 by slender links 21 of the lead frames 12 extending rearwardly of the insulative block 16 to the carrier strips 7. The slender links 21 are easily bent toward each other to bring the carrier strips 7 together. The carrier strips 7 can be joined together by rivets 22, FIG. 2, passing through the aligned pilot holes 11. Alternatively, the slender links 21 of the lead frames 12 can be unbent, FIG. 3, to maintain the carrier strips 7 separated from each other.

Figure 2:
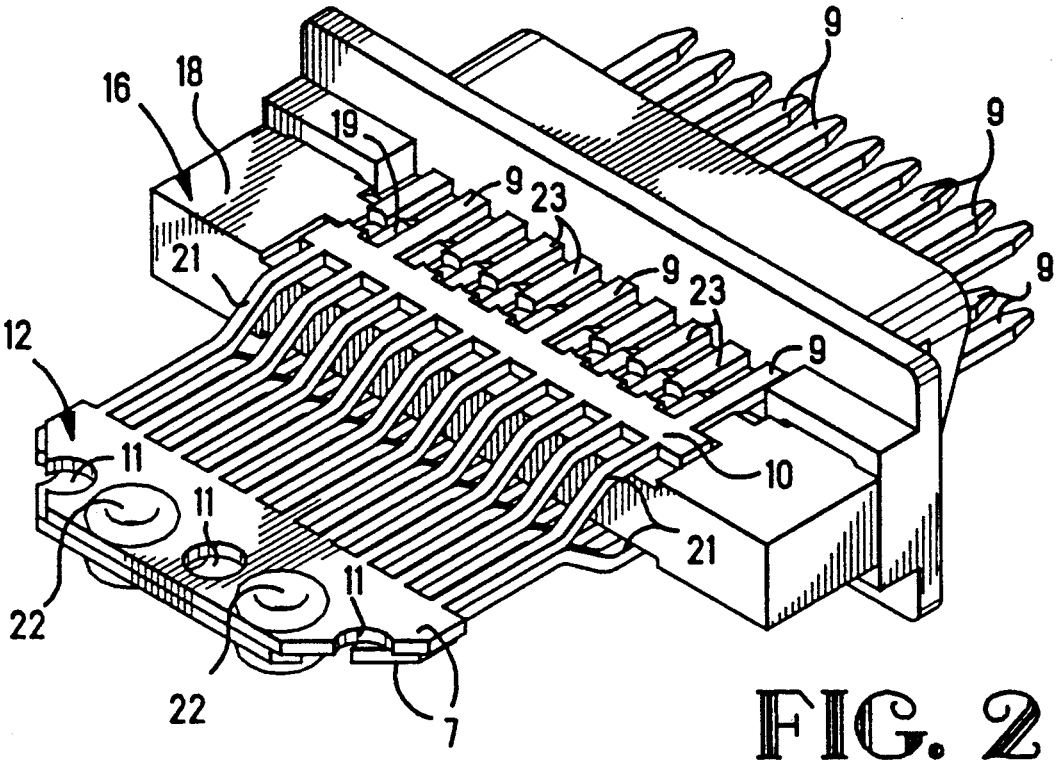
FIG. 2 is a perspective view illustrating the parts shown in FIG. 1 assembled together.

The contacts 9 are constructed to be separated from the ground bus 10. In FIGS. 2.5, selected ones of the contacts 9 are separated from the ground bus 10, for example, by punching or by drilling the contacts 9 to sever them, leaving free ends 23 of the contacts 9. The contacts 9 are supported against the insulative block 16 after being separated from the ground bus 10. To prevent electrical shorting, the free ends 23 are separated from one another by respective fingers 19, and the fingers 19 are alongside the free ends 23. At least one electrical contact 9 of the row remains joined to the ground bus 10.

Figure 3:
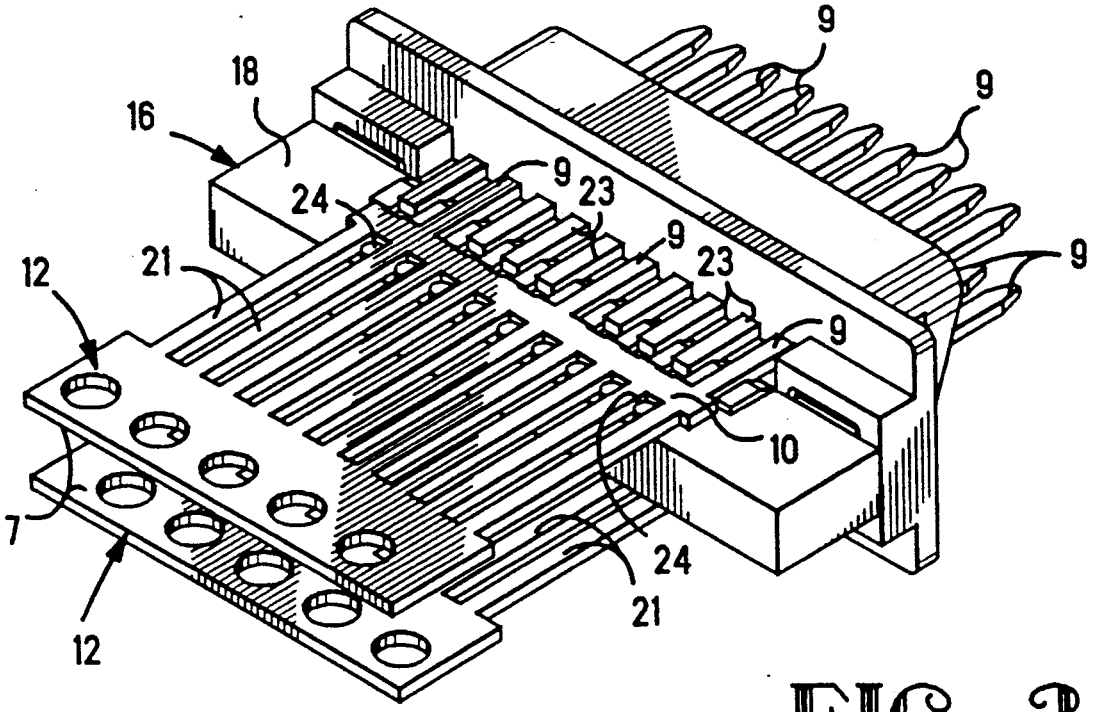
FIG. 3 is a perspective view similar to FIG. 2, with a modified insulative block.

With reference to FIG. 3, a modified, insulative block 16 comprises a row of spaced apart knobs 24 on each surface 18 rearward of a ground bus 10 supported on the surface 18. The knobs 24 are between the slender links 21 of the lead frame 12 that extend rearwardly from the ground bus 10 that is in a space between the row of knobs 24 and the row of fingers 19.

The ground bus 10 provides a continuous surface for direct connection of each ground wire 5 of at least one electrical cable 1. The thickness of each of the fingers 19 is less than the thickness of the ground bus 10. The ground bus 10 supported on said insulating block 16 projects higher than the fingers 19. The contacts 9 supported against said insulating block 16 project higher than the fingers 19. This raises the surfaces of the ground bus 10 and of the contacts 9 for ease in direct connection to corresponding ground wires 5 and signal wires 2 by welding, and alternatively, by solder joining. Each of the contacts 9 remaining joined to the ground bus 10, and each of the free ends 23 of selected ones of the contacts 9, are supported against the insulative block 16 while being connected to respective signal wires 2 of at least one electrical cable 1. The thickness of each the fingers 19 is less than the thickness of each of the contacts 9 supported against the insulating block 16, allowing for the weld joining or solder joining of the contacts 9 to respective wires 2.

We claim:

1. An electrical connector assembly comprising: an insulative block, a conductive ground bus supported against the insulative block, an insulative housing block, multiple electrical contacts joining the ground bus and projecting outwardly of the housing block for connection to wires of at least one electrical cable, selected ones of the contacts being constructed for detachment from the ground bus to provide free ends of said ones of the contacts, and at least one of the contacts being constructed to remain joined to the ground bus, the ground bus being supported against the insulative block, and each of the contacts being supported against the insulative block, said free ends being supported against the insulative block while being connected to respective wires of at least one electrical cable.

2. An electrical connector assembly as recited in claim 1, comprising: the insulating block being latched to the housing block.

3. An electrical connector assembly as recited in claim 1, comprising: fingers on the insulative block between adjacent contacts, and each of said free ends being alongside respective said fingers.

4. An electrical connector assembly as recited in claim 3, comprising: the free ends supported against said insulating block projecting higher than the fingers on said insulating block.

5. An electrical connector assembly as recited in claim 3, comprising: a lead frame joining the ground bus and the contacts, the lead frame extending rearwardly of the insulating block to a carrier strip.

6. An electrical connector assembly as recited in claim 5, comprising: a second lead frame joining additional electrical contacts to a second ground bus supported against the insulative block, the second lead frame extending rearwardly of the insulating block to a second carrier strip, and the carrier strips being joined together.

7. An electrical connector assembly comprising: an insulative block, an insulative housing block, a conductive ground bus supported against the insulative block, multiple electrical contacts in first and second rows projecting outwardly of the housing block for connection to wires of at least one electrical cable, a first ground bus and a second ground bus supported against the insulative block, each said ground bus being connected to the contacts of one of said rows, selected ones of the contacts being constructed for detachment from said ground bus to provide free ends of said ones of the contacts, at least one of the contacts in each row being constructed to remain joined to said ground bus, each of the contacts being supported against the insulative block, and said free ends being supported against the insulative block while being connected to respective wires of at least one electrical cable.

8. An electrical connector assembly as recited in claim 7, comprising: a first lead frame joining the first ground bus and the contacts of the first row, a second lead frame joining the second ground bus and the contacts of the second row, said lead frames extending rearwardly of the insulating block to join respective, first and second carrier strips.

9. An electrical connector assembly as recited in claim 8, comprising: the carrier strips being joined together.

10. An electrical connector assembly as recited in claim 9, comprising: a rivet extending through aligned pilot holes in the carrier strips.

11. A connector assembly comprising: first and second rows of conductive signal contacts, an insulative housing block applied over the signal contacts, the contacts of each row projecting from the housing block and being joined to a first ground bus or a second ground bus, a separator between the first and second rows, cooperating latch elements on the housing and on the separator, the contacts and each ground bus being supported against the separator, at least a selected one of the signal contacts being separated from the ground bus, and the separator having raised fingers between adjacent contacts of each row.

12. A connector assembly as recited in claim 11, comprising: the thickness of the fingers being less than the thickness of the contacts supported against the separator, allowing for weld joining of the contacts to respective wires.

13. A connector assembly as recited in claim 11, comprising: front ends of the fingers being tapered for passage of each bus bar over respective fingers.

14. A connector assembly as recited in claim 11, comprising: each of the separated fingers having a free end between said fingers, and the free ends of the separated fingers being supported against the separator.

15. A connector assembly as recited in claim 11, comprising: each ground bus joined by slender links to a carrier strip, the carrier strips being joined together rearwardly of the separator.

16. A connector assembly as recited in claim 15, comprising: projecting knobs on the separator between adjacent links.

* * * * *